US011225305B2

(12) United States Patent
Lyon

(10) Patent No.: US 11,225,305 B2
(45) Date of Patent: Jan. 18, 2022

(54) HYDROFOIL ASSEMBLY WITH INDEXING WING ADJUSTMENT

(71) Applicant: Tyler Lyon, Salt Lake City, UT (US)

(72) Inventor: Tyler Lyon, Salt Lake City, UT (US)

(73) Assignee: Bi-Thermal Aspen Earth, L.L.C., Salt Lake City, UT (US)

( * ) Notice: Subject to any disclaimer, the term of this patent is extended or adjusted under 35 U.S.C. 154(b) by 0 days.

(21) Appl. No.: 17/020,557

(22) Filed: Sep. 14, 2020

(65) Prior Publication Data

US 2021/0253201 A1 Aug. 19, 2021

Related U.S. Application Data

(60) Provisional application No. 62/900,062, filed on Sep. 13, 2019.

(51) Int. Cl.

| | |
|---|---|
| ***B63B 32/64*** | (2020.01) |
| *B63B 32/66* | (2020.01) |
| *B63B 1/28* | (2006.01) |

(52) U.S. Cl.

CPC ..... *B63B 32/64* (2020.02); *B63B 1/285* (2013.01); *B63B 32/66* (2020.02)

(58) Field of Classification Search

CPC ..... B63B 1/242; B63B 32/64; B63B 32/66; B63B 1/285

See application file for complete search history.

(56) References Cited

U.S. PATENT DOCUMENTS

| | | | | |
|---|---|---|---|---|
| 4,676,183 | A * | 6/1987 | Conboy | A01K 73/025 114/245 |
| 5,100,354 | A | 3/1992 | Woolley et al. | |
| 5,249,998 | A | 10/1993 | Woolley et al. | |
| 5,309,859 | A * | 5/1994 | Miller | B63B 32/66 114/274 |
| 5,704,581 | A * | 1/1998 | Chen | F16M 11/10 248/181.2 |
| 6,551,158 | B2 | 4/2003 | Murphy | |
| 6,805,068 | B1 * | 10/2004 | Tossavainen | B63B 1/285 114/274 |
| 7,144,285 | B1 * | 12/2006 | Hendricks | B63B 32/60 441/74 |
| 7,232,355 | B2 | 6/2007 | Woolley | |

(Continued)

*Primary Examiner* — Andrew Polay

(74) *Attorney, Agent, or Firm* — Bretton L. Crockett; TechLaw Ventures, PLLC

(57) ABSTRACT

Systems, apparatus, and methods for hydrofoil assemblies with planing blades that may be adjusted, and securely maintained in varying tilts with respect to a support member, using a curved indexing system with a curved ridge and a counterpart groove that utilize interacting position retaining elements to retain a desired tilt in different adjustable positions. In one illustrative system, a planing blade may have a convexly curved ridge disposed on a surface thereof with a series of transverse grooves disposed in the curved ridge. A support member may have a counterpart concavely curved receiver with a series of counterpart transverse grooves formed therein. When a user places the planing blade in position with the convex ridge contacting the concave receiver, the blade may be tilted to a desired position. The counterpart transverse grooves interconnect to provide an indexed positive interlock, securely maintaining the blade in the desired position.

20 Claims, 2 Drawing Sheets

(56) References Cited

U.S. PATENT DOCUMENTS

| | | | | |
|---|---|---|---|---|
| 7,980,191 | B2 | 7/2011 | Murphy | |
| 9,260,177 | B2 | 2/2016 | Willdig et al. | |
| 9,586,659 | B2 | 3/2017 | Langelaan | |
| 9,896,168 | B1 * | 2/2018 | Lindbergh | B63B 32/60 |
| 2015/0225040 | A1 * | 8/2015 | Geislinger | B63B 1/248<br>441/79 |
| 2016/0185408 | A1 * | 6/2016 | Henderson | B62J 1/08<br>297/215.15 |

* cited by examiner

HYDROFOIL ASSEMBLY WITH INDEXING WING ADJUSTMENT

CROSS-REFERENCE TO RELATED APPLICATION

This application claims the benefit of U.S. Provisional Application No. 62/900,062, filed Sep. 13, 2019, which is incorporated herein by reference in its entirety, including but not limited to those portions that specifically appear hereinafter.

BACKGROUND

This disclosure relates generally to methods, systems, and devices for the positioning of wings on hydrofoil assemblies. Many current hydrofoil surfboards and water skis include front and rear planing blades, both disposed parallel to the elongate main board, on the front and rear of a support member attached to a strut extending downwards from the board. By running generally parallel to the main board, such planing blades provide essentially no lift when the main ski is horizontal. Such blades typically are not adjustable. One adjustable wing assembly, commercially offered by NAISH, utilizes a longitudinal slot accessible in the upper surface of the support member into which a downwardly extending fin member is inserted. A user may tip the wing to a desired position, then tighten bolts on the side of the support member to tighten the slot. However, such an arrangement does not allow for an exact reproducible adjustment.

An adjustable hydrofoil planing assembly that provided users with the ability to perform exact reproducible adjustments on a planing blade or wing would be an improvement in the art. Such a system that included features for securely maintaining the desired angle during use would be a further improvement in the art.

SUMMARY

This disclosure extends to systems, apparatus, and methods for hydrofoil assemblies with planing blades or wings that may be adjusted to, and securely maintained in varying tilts with respect to a support member such as an extending fuselage or strut, using a curved indexing system with a curved ridge and a counterpart groove that utilize interacting position retaining elements to retain a desired tilt in different adjustable positions. For example, in one illustrative system in accordance with the present disclosure, a planing blade may have a convexly curved ridge disposed on a surface thereof, generally extending in the front to rear direction. A series of transverse grooves may be disposed in the curved ridge. A central support for attachment to the planing blade may have a counterpart concavely curved receiver formed therein. The curved receiver member may have series of counterpart transverse grooves formed therein. When a user places the planing blade in position with the convex ridge contacting the concave receiver, the blade may be tilted to a desired position. The counterpart transverse grooves interconnect to provide an indexed positive interlock, securely maintaining the blade in the desired position. It will be appreciated that alternate embodiments the placement of the curved ridge and recess may be reversed or vary for a particular application.

The features and advantages of the disclosure will be set forth in the description, which follows, and in part will be apparent from the description, or may be learned by the practice of the disclosure without undue experimentation.

The features and advantages of the disclosure may be realized and obtained by means of the instruments and combinations particularly pointed out in the appended claims. Any discussion of documents, acts, materials, devices, articles or the like, which has been included in the specification is not to be taken as an admission that any or all these matters form part of the prior art base, or were common general knowledge in the field relevant to the disclosure as it existed before the priority date of each claim of this disclosure.

DESCRIPTION OF THE DRAWINGS

Non-limiting and non-exhaustive implementations of the disclosure are described with reference to the following figures, wherein like reference numerals refer to like parts throughout the various views unless otherwise specified. Advantages of the disclosure will become better understood with regard to the following description and accompanying drawings where.

DETAILED DESCRIPTION

Figure 1A:
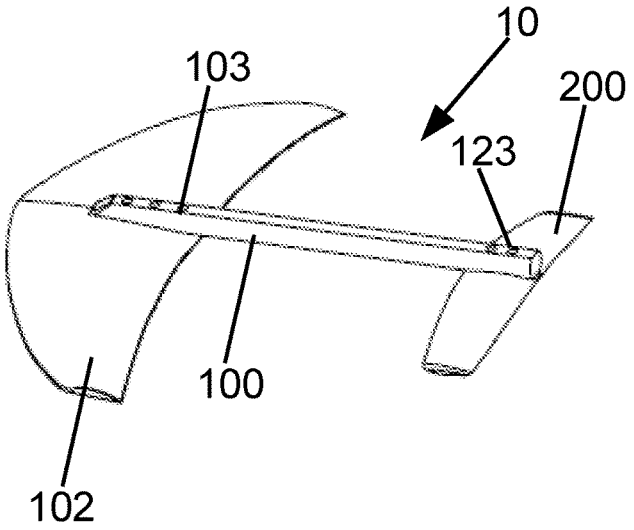
FIG. 1A illustrates a top perspective view of a hydrofoil blade assembly for use with a waterski or surfboard system.
Figure 1B:
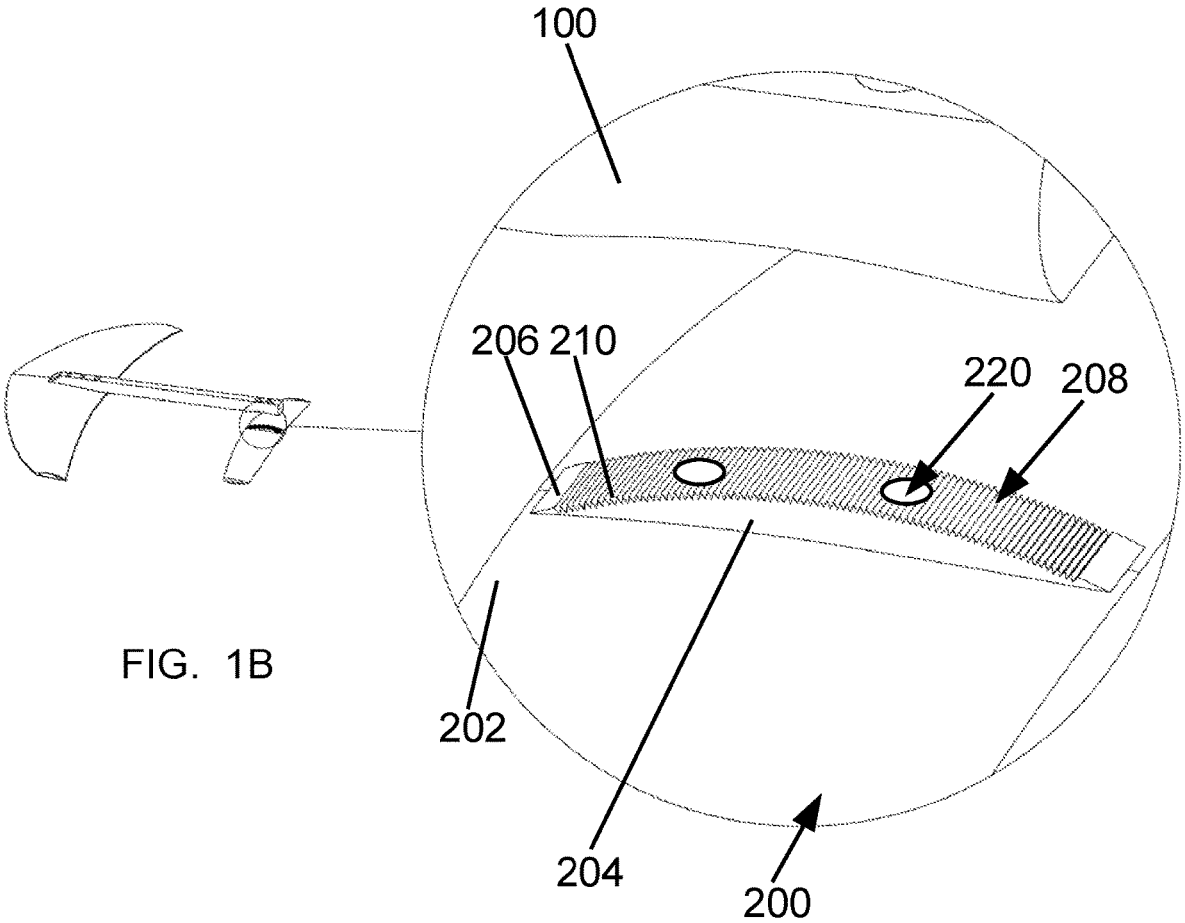
FIG. 1B illustrates an enlarged view of a portion of the assembly of FIG. 1A.

The disclosure extends to methods, systems, and devices for hydrofoil assemblies with planing blades or wings that may be adjusted to, and securely maintained in varying tilts. In the following description of the disclosure, reference is made to the accompanying drawings, which form a part hereof, and in which is shown by way of illustration specific implementations in which the disclosure may be practiced. It is understood that other implementations may be utilized, and structural changes may be made without departing from the scope of the disclosure.

Before the methods, systems and devices of the present disclosure are discussed and described, it is to be understood that this disclosure is not limited to the particular configurations, process steps, and materials disclosed herein as such configurations, process steps, and materials may vary somewhat. It is also to be understood that the terminology employed herein is used for the purpose of describing implementations only and is not intended to be limiting since the scope of the disclosure will be limited only by the appended claims and equivalents thereof.

In describing and claiming the disclosure, the following terminology will be used in accordance with the definitions set out below.

It must be noted that, as used in this specification and the appended claims, the singular forms "a," "an," and "the" include plural referents unless the context clearly dictates otherwise.

As used herein, the terms "comprising," "including," "containing," "characterized by," and grammatical equivalents thereof are inclusive or open-ended terms that do not exclude additional, unrecited elements or method steps.

Further, although specific implementations of the disclosure have been described and illustrated, the disclosure is not to be limited to the specific forms or arrangements of parts so described and illustrated. The scope of the disclosure is to be defined by the claims appended hereto, any future claims submitted here and in different applications, and their equivalents.

A first example of an embodiment of an adjustable planing blade assembly 10 in accordance with the teachings of the present disclosure is depicted in FIGS. 1A, 1B, 2A, and 2B. A central support member 100, also known as a fuselage, provides an attachment point for one or more planing blades. In the depicted embodiment, there is a forward planing blade 102 and a rear planing blade 200. It will be appreciated that the number of planing blades in a particular assembly may vary. The central support member 100 also provides an attachment point for a mast that extends upwards from the assembly to an elongate waterski or surfboard member for use.

The central support member 100 may be formed of any suitable material having sufficient strength and durability for the intended use. In the depicted embodiment, it may be formed from a plastic material, such as a glass reinforced polymer. In other embodiments, other suitable materials may be used. For example, a reinforced structure having a hollow steel tube as a central core, over which a polymeric material is molded, can provide strength and attachment capabilities form the metal core, and surface durability and reduced friction to fluid flow during use from a suitable surface material.

The rear planing blade 200 may have an upper surface 202 and an opposite lower surface 203. It will be appreciated that the particular shape of the planing blade 200 may vary for particular applications. A convexly curved ridge 204 may be disposed on the upper surface 202, generally extending in the front to rear direction and having a curved top 206. As depicted, the ridge 204 may be formed having columnar sides and a curved top that generally follows the arc of a sphere. It will be appreciated that the relative size and placement of the ridge 204 and the dimension and angles of the curve top 206 may vary for particular installations, to optimize the ability of the planning blade and support to be retained in different positions along the curved top for such installation.

As depicted, a series of index structures, such as transverse grooves 208 may be disposed in the curved top 206. In the depicted embodiment, the transverse grooves 208 may be formed by a series of triangular ridges 210 separated by triangular grooves. This allows the transverse grooves 208 to function in a manner similar to the "teeth" on a gear. It will be appreciated that in addition to the depicted triangular shape, other indexing structures may be used. For example, transverse grooves having a curved profile and separated by curved ridges could be used, grooves having a rectangular profile separated by rectangular ridges, or other interconnection structures and profiles known to those of skill in the art can be used.

One or more connection ports 220 for the passage of a connecting bolt through the planing blade 200 and convex ridge 204 may be present. On the opposite surface 203 of the planing blade, a connection port 240 may be surrounded by a beveled curve to allow for movement of the planing blade and to provide a seat for a bolt with an angled head.

Figure 2A:
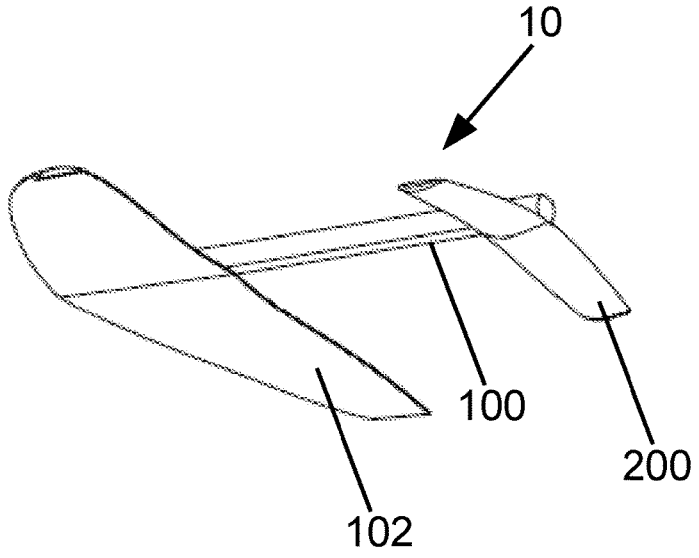
FIG. 2A illustrates a bottom perspective view of the assembly of FIGS. 1A and 1B.
Figure 2B:
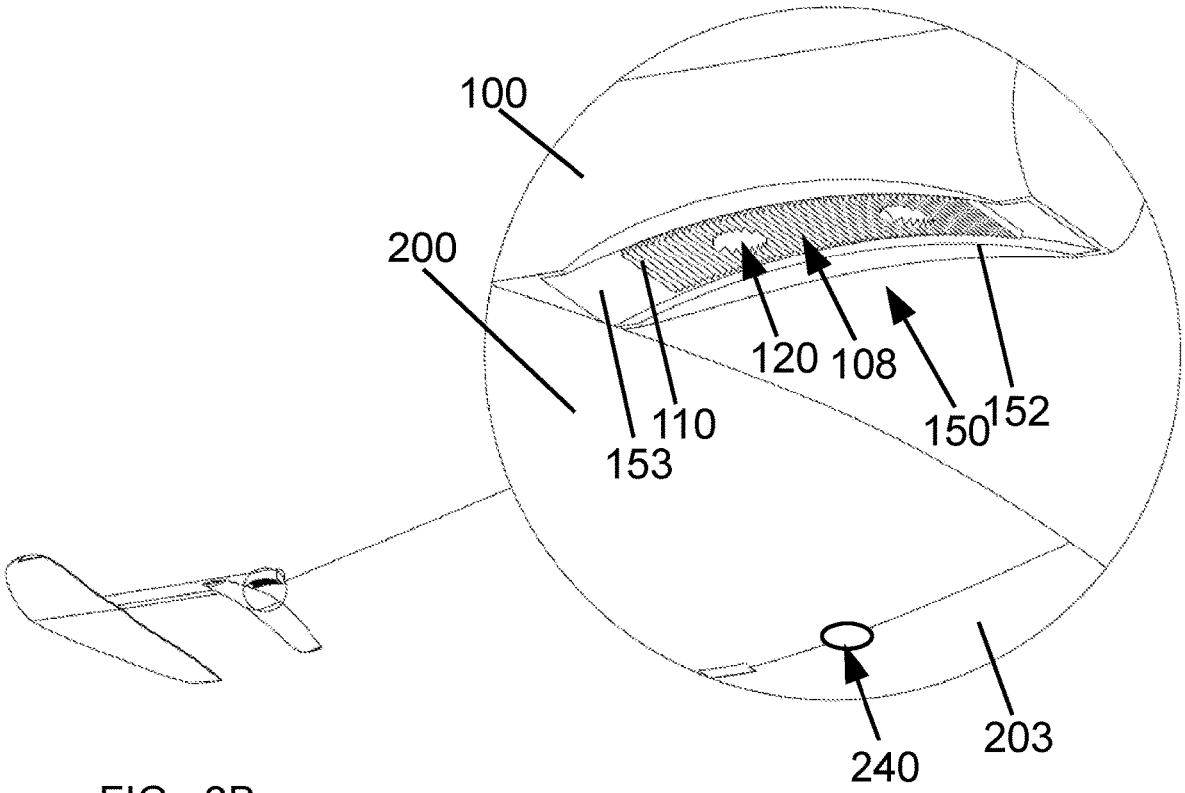
FIG. 2B illustrates an enlarged view of a portion of the assembly of FIGS. 1A through 2A.

As best depicted in FIG. 2B, the central support 100 may have a counterpart concavely curved receiver 150 formed therein or disposed thereon. The curved receiver 150 may be disposed in slot extending lengthwise along the central support 100, which may have an opening defined by curved sidewalls 152 that may correspond to the facing surface 202 of planing blade 200. This allows the planing blade to abut the upper surface of the curved sidewalls and close the receiver when secured therein, reducing drag during use.

Concave receiver 150 may have a concave facing surface 153, member may have series of counterpart transverse grooves formed therein. It will be appreciated that the curved facing surface 153 may be formed to correspond to the curved top 206 of ridge 204, to allow the ridge 204 to be position therein in multiple positions having different tilts.

As depicted, a series of index structures, such as transverse grooves 108 may be disposed in the curved surface 153. In the depicted embodiment, the transverse grooves 108 may be formed by a series of triangular ridges 110 separated by triangular grooves. This allows the transverse grooves 108 to function in a manner like the "teeth" on a gear when interacting with the counterpart grooves 208 on planing blade 200. It will be appreciated that in addition to the depicted triangular shape, other indexing structures may be used. For example, transverse grooves having a curved profile and separated by curved ridges could be used, grooves having a rectangular profile separated by rectangular ridges, or other interconnection structures and profiles known to those of skill in the art can be used. The use of interconnection structures that allow the blade to be adjusted by tilting as the interconnection structures "mesh" allows for fine adjustments to be made with the interconnection structures in place before the system is secured for use.

One or more connection ports 120 for the passage of a connecting bolt through the planing blade 200, convex ridge 204, and concave member 150 may be present. It will be appreciated that depending on the construction of the support member 100, the ports 120 may lead to a seat formed on the opposite surface for placement of a fastener, such as a nut, to which a bolt may be connected, or to a connection port formed in an internal reinforcing member, such as a metal rod or tube disposed in the connection member 100. It will be appreciated that although two connection port 120 are depicted, that this is merely illustrative and any suitable retaining system or number of ports, including a single connection port or a plurality of ports may be used as may be appropriate for a particular installation.

For use, a user may place the planing blade 200 in position with the convex ridge 202 contacting the concave receiver 152 of the support member with the blade 200 tilted to tilted to a desired position. The counterpart indexing structures, such as counterpart transverse grooves 208 and 108 interconnect to provide an indexed positive interlock, securely maintaining the blade in the desired position, once secured therein as by the bolt(s), resisting movement during use from the abutting nature of the interconnection. To adjust the tilt, a user can loosen the fastener (such as the bolts) and tilt the blade 200, using the gear-like interaction of the indexing structures, or simply reposition the blade 200 by lifting and setting it in the desired position. The fastener(s) may then be actuated to secure the blade in place.

In the depicted embodiment for FIGS. 1A through 2B, the front planing blade 102, is shown as being fixed in a single position and held therein by a set of bolts 103. It will be appreciated that embodiments where multiple blades include the indexing securing features allowing for adjustment of the blade angle that is maintained during use may be constructed and used in accordance with the teachings of the present disclosure. Such embodiments may include the necessary components, such as a convex ridge on the front blade 102 and a corresponding concave receiver member for the front blades disposed on the support member 100.

It will be further appreciated that in addition to the triangular grooves and ridges depicted in the FIGS, that other indexing structures and connection may be used and are within the teachings of this disclosure. For example, an exemplary embodiment that lacks grooves, and instead features knurled or roughened curved surfaces that contacted one another with sufficient frictional engagement to prevent slippage during installation and adjustment as well as use could be used. Similarly, smooth curved surfaces that are formed of material having sufficient frictional engagement under the pressure from the fasteners (such as bolts) may be used. It will be further appreciated, that in addition to bolts passing though the ports discussed previously herein, that other suitable fasteners may be used.

In the foregoing Detailed Description, various features of the disclosure are grouped together in a single implementation for streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed implementation. Thus, the following claims are hereby incorporated into this Detailed Description by this reference, with each claim standing on its own as a separate implementation of the disclosure.

It will be further appreciated that the embodiments depicted and discussed in this disclosure are exemplary rather than limiting. For example, in the depicted embodiments, the convex receiver member is disposed on the support member and the concave ridge is disposed on the planing blade, this could be reversed. Additionally, embodiments where the planing blade may be attached to any side of the support member, or different planing blades may be attached to different sides thereof (such as top and bottom or opposite lateral sides).

It will be further appreciated that the number of planing blades may vary in a system. Additionally, different planing blades having different shapes and properties may be used. For example, planing blades of differing sizes and shapes that have different lift properties may be desirable for use in differing hydrofoil applications, such as surfboards, water skis, kite boards, and the like. The principles of the present disclosure may be used to provide tiltable planing wings with different properties for such differing applications.

It is to be understood that the above-described arrangements are only illustrative of the application of the principles of the disclosure. Numerous modifications and alternative arrangements may be devised by those skilled in the art without departing from the spirit and scope of the disclosure and the appended claims are intended to cover such modifications and arrangements. Thus, while the disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. An adjustable planing blade assembly for a hydrofoil, comprising:

at least a first planing blade, the at least first planing blade having a first surface, and a convex ridge disposed on the first surface of the planing blade which generally extends in a front to rear direction;

a central support member for attachment to the at least first planing blade, the central support member comprising a concavely curved receiver formed such that when the at least first planing blade is placed in position with the convex ridge contacting the concavely curved receiver, the at least first planing blade may be tilted to a desired position by moving the curved surfaces with respect to one another, and at least one fastener for securing the planing blade to the central support member to maintain the desired position.

2. The assembly of claim 1, wherein the convex ridge and concavely curved receiver surfaces each include counterpart indexing structures that interconnect to provide an indexed positive interlock.

3. The assembly of claim 2, wherein the counterpart indexing structures comprise counterpart series of transverse grooves disposed in the respective curved surfaces of the ridge and receiver.

4. The assembly of claim 3, wherein the counterpart series of transverse grooves comprise triangular grooves separated by triangular ridges.

5. The assembly of claim 1, wherein the concavely curved receiver has a concave curve that corresponds to the curve of the convex ridge.

6. The assembly of claim 1, wherein the concavely curved receiver is disposed in a groove opening on an upper surface of the central support member, which is defined by opposite parallel sidewalls extending along a long axis of the central support member.

7. The assembly of claim 6, wherein the upper surface of the central support member surrounding the concavely curved receiver is curved to abut the first surface of the at least first planing blade and thereby close the concavely curved receiver.

8. The assembly of claim 1, wherein convexly curved ridge comprises two opposite planar sidewalls joined by a curved upper surface.

9. The assembly of claim 1, wherein the at least first planing blade is formed as a generally wing-shaped member.

10. The assembly of claim 1, wherein the central support member further comprises an attachment structure for connection to a vertical mast for connection to a sport board.

11. The assembly of claim 1, wherein the at least one fastener comprises at least one bolt that passes through a port in the at least first planing blade to secure in a receptacle in the central support member.

12. An adjustable planing blade system, comprising:

a planing blade, having a first planing surface and a second planing surface, and a convex ridge disposed on the first planing surface; and a fuselage member having a longitudinal axis and comprising a concavely curved receiver accessible at a first surface thereof, the concavely curved receiver formed such that when the planing blade is placed in position with the convex ridge contacting the concave receiver, the planing blade may be tilted to a desired position by moving the convex ridge to a desired position along the surface of the concavely curved receiver.

13. The system of claim 12, wherein the convex ridge and the concave receiver surfaces each include counterpart indexing structures that interconnect to provide an indexed positive interlock.

14. The system of claim 13, wherein the counterpart indexing structures comprise counterpart series of transverse grooves disposed in the respective curved surfaces of the ridge and receiver.

15. The system of claim 14, wherein the counterpart series of transverse grooves comprise triangular grooves separated by triangular ridges.

16. The system of claim 12, wherein the convex ridge comprises two opposite planar sidewalls joined by a curved upper surface and the concavely curved receiver is disposed in a groove opening on an upper surface of the fuselage, which is defined by two opposite parallel sidewalls extending along the longitudinal axis of fuselage.

17. The system of claim 16, wherein the upper surfaces of the two opposite parallel sidewalls are curved to abut the first planing surface of the planing blade and thereby close the concavely curved receiver.

18. The system of claim 12, wherein the fuselage further comprises an attachment structure for connection to a vertical mast for connection to a sport board.

19. The system of claim 12, further comprising at least one fastener for securing the planing blade to the fuselage to maintain the desired position.

20. The system of claim 19, wherein the at least one fastener comprises at least one bolt that passes through a port in the planing blade to secure in a receptacle in the fuselage.

* * * * *